US006204333B1

(12) United States Patent
Higuchi et al.

(10) Patent No.: US 6,204,333 B1
(45) Date of Patent: Mar. 20, 2001

(54) SOLID GOLF BALL

(75) Inventors: Hiroshi Higuchi; Hisashi Yamagishi; Yasushi Ichikawa; Junji Hayashi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/124,361

(22) Filed: Jul. 29, 1998

(30) Foreign Application Priority Data

Jul. 30, 1997 (JP) ..... 9-219284

(51) Int. Cl.[7] ..... A63B 37/12

(52) U.S. Cl. ..... 525/221; 525/196; 525/201; 473/373; 473/374

(58) Field of Search ..... 473/373, 374; 525/196, 201, 221

(56) References Cited

U.S. PATENT DOCUMENTS 5,586,950 * 12/1996 Endo .
5,730,664 * 3/1998 Asakura .
5,803,832 * 9/1998 Nakamura .
5,820,487 * 10/1998 Nakamura .

FOREIGN PATENT DOCUMENTS 2 306 118 4/1997 (GB) .

OTHER PUBLICATIONS

Himilan Ionomer Resin Brochure—Dupont.*
Derwent Abstract of J62275480, J09010358, J93004110.
Derwent Abstract of J07024084, J07024085.

* cited by examiner

*Primary Examiner*—David J. Buttner
(74) *Attorney, Agent, or Firm*—Sughrue, Mion, Zinn, Macpeak & Seas, PLLC

(57) ABSTRACT

In a solid golf ball having a solid core, a cover inner layer and a cover outer layer, the inner layer is formed of a thermoplastic resin containing 60–100% by weight of an ionomer resin neutralized with a monovalent metal salt, and the outer layer is formed of a thermoplastic resin containing 60–100% by weight of an ionomer resin neutralized with a divalent metal salt. The difference in Shore D hardness between the inner and outer layers is within 5 Shore units. While maintaining superior flight performance and durability, the inventive ball presents a more pleasant feel.

14 Claims, 1 Drawing Sheet

SOLID GOLF BALL

BACKGROUND OF THE INVENTION

1. Field of the Invention

This invention relates to a solid golf ball comprising a solid core and a two-layer cover, and more particularly, such a golf ball which is improved in feel at no sacrifice of flight performance and durability.

2. Related Art

Golf balls having a variety of constructions are available today on the market. The majority of commercial golf balls are either two-piece solid golf balls comprising a rubber-based core and a cover composed of ionomer resin or the like, or thread-wound golf balls comprising a thread-wound core obtained by winding rubber thread about a solid or liquid center, and a cover formed over the core.

Most golfers of ordinary skill use two-piece solid golf balls because of their excellent flight performance and durability. However, these balls have a very hard feel and are poor in control due to the rapid separation of the ball from the club head. For this reason, many professional golfers and skilled amateurs prefer using thread-wound balls to two-piece solid balls. Yet, although thread-wound golf balls have a superior feel and control, their distance and durability fall short of those for two-piece balls.

Thus, two-piece solid golf balls and thread-wound golf balls today provide mutually opposing features, and so golfers select which type of ball to use based on their level of skill and personal preference.

In order to produce solid golf balls presenting a feel close to that of wound golf balls when hit, we made a number of proposals using three-piece solid golf balls comprising a solid core, a cover inner layer and a cover outer layer, as disclosed in JP-B 8301/1995, JP-A 24084/1995 and JP-A 10358/1997. These patents disclose golf balls wherein the cover outer layer is formed harder than the cover inner layer, and the balls are designed so as to acquire a lower spin rate upon shots intended for distance like driver shots.

These balls are advantageous in flight distance, but they are difficult to stop due to the low spin structure.

By contrast, many proposals were also made on golf balls which are improved in control, as disclosed in JP-B 4110/1993 and JP-A 24085/1995. These golf balls are characterized in that the cover inner layer is formed harder than the cover outer layer. It is intended to increase spin by softening the cover outer layer to increase the friction of the ball with the club face. Despite the advantage of increased spin, these golf balls, however, sometimes fail to increase the flight distance because of the soft cover outer layer inviting a loss of resilience.

SUMMARY OF THE INVENTION

Therefore, an object of the invention is to provide a solid golf ball which is improved in feel at no sacrifice of the superior flight performance and durability inherent to solid golf balls.

The invention is directed to a solid golf ball comprising a solid core formed of a base rubber and a cover of two-layer structure consisting of an inner layer surrounding the solid core and an outer layer surrounding the inner layer. According to the invention, the cover inner layer is formed of a thermoplastic resin containing 60 to 100% by weight of an ionomer resin neutralized with a monovalent metal salt, and the cover outer layer is formed of a thermoplastic resin containing 60 to 100% by weight of an ionomer resin neutralized with a divalent metal salt. These cover layers are adjusted such that the difference in Shore D hardness between the inner layer and the outer layer is within 5 Shore units. Then, while maintaining the superior flight performance and durability inherent to solid golf balls, the ball is improved in feel, that is, presents a soft feel when hit.

In one preferred embodiment, the cover inner layer and the cover outer layer each have a Shore D hardness in the range of 50 to 70 and/or a gage of 0.5 to 3 mm; and the solid core is based on polybutadiene and undergoes a deflection of 3 to 7 mm under an applied load of 100 kg. Then the aforementioned advantages are enhanced.

BRIEF DESCRIPTION OF THE DRAWINGS

The only figure.

DETAILED DESCRIPTION OF THE INVENTION

Figure 1:
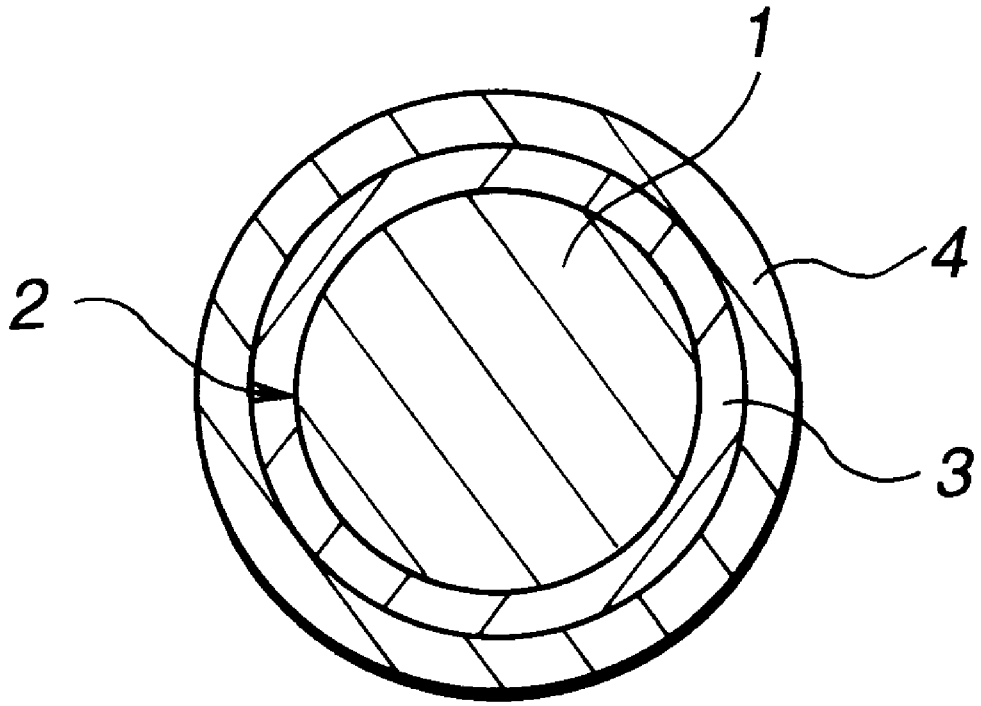
FIG. 1, is a schematic cross-sectional view of a solid golf ball according to one embodiment of the invention.

Referring to FIG. 1, the solid golf ball according to the present invention is shown as comprising a spherical solid core 1 and a cover 2 formed on the surface of the core. The cover 2 is formed of a two-layer structure consisting of a cover inner layer 3 surrounding the solid core 1 and a cover outer layer 4 surrounding the inner layer 3. The ball shown in FIG. 1 is a three-piece ball having a solid core of a single layer although the solid core can be a multilayer core consisting of two or more layers if necessary.

The solid golf ball of the invention is described in further detail. Reference is first made to the embodiment wherein the ball of the invention is a three-piece ball having a single layer core. The solid core is composed mainly of a base rubber. The base rubber used herein may be any natural rubber and/or synthetic rubber used in conventional solid golf balls, although a rubber composition based on 1,4-cis-polybutadiene containing at least 40% cis structure is especially preferable in the invention. The polybutadiene may be blended with a suitable amount of natural rubber, polyisoprene rubber, styrene-butadiene rubber or the like if desired. Where the core is of multilayer structure, its center core and a core enclosure may also be formed from rubber compositions similar to the above.

The hardness of the solid core 1 is not critical although it is recommended that the solid core has a hardness corresponding to a deflection of 3 to 7 mm, more preferably 3.1 to 6.5 mm, and most preferably 3.2 to 6.0 mm, under an applied load of 100 kg. The solid core is usually formed to a diameter of 33 to 41 mm, preferably 34 to 40 mm, and more preferably 35 to 40 mm.

According to the invention, the cover is formed to a two-layer structure consisting of inner and outer layers. The cover inner layer, the cover outer layer and the hardness difference therebetween are optimized. Specifically, the cover inner layer 3 is formed of a thermoplastic resin containing 60 to 100% by weight of an ionomer resin neutralized with a monovalent metal salt, and the cover outer layer 4 is formed of a thermoplastic resin containing 60 to 100% by weight of an ionomer resin neutralized with a divalent metal salt. The difference in Shore D hardness between the inner layer and the outer layer is within 5 Shore units.

The cover inner layer is formed of a thermoplastic resin containing 60 to 100%, especially 65 to 100% by weight of an ionomer resin neutralized with a monovalent metal salt.

If the content of the ionomer resin neutralized with a monovalent metal salt is less than 60% by weight, there would result a loss of resilience and hence, a loss of distance.

The metal ion of the monovalent metal salt includes sodium and lithium ions. The ionomer resins neutralized with a monovalent metal salt are commercially available, for example, sodium salt neutralization type ionomer resins under the trade name of Himilan 1605 by Mitsui-duPont Polychemicals K.K. and Surlyn 8320 and AD8512 by E. I. duPont; and lithium salt neutralization type ionomer resins under the trade name of Surlyn 7930 by E. I. duPont. These ionomer resins may be used alone or in admixture of two or more.

Another resin may be blended in the inner layer cover stock as long as the above-defined content of the specific ionomer resin is satisfied. Examples of other resins which can be used herein include ionomer resins neutralized with a polyvalent metal salt and thermoplastic elastomers, for example, zinc salt neutralization type ionomer resins available under the trade name of Himilan 1706 by Mitsui-duPont Polychemicals K.K. and Surlyn 9320 by E. I. duPont; magnesium salt neutralization type ionomer resins available under the trade name of Himilan AM7311 by Mitsui-duPont Polychemicals K.K.; thermoplastic elastomers having crystalline polyethylene blocks available under the trade name of D6100P Dynaron by Nippon Synthetic Rubber K.K.; polyester thermoplastic elastomers, maleic anhydride modified products of ethylene-alkyl unsaturated carboxylate copolymers, and ethylene-unsaturated carboxylic acid-alkyl unsaturated carboxylate terpolymers.

The cover outer layer is formed of a thermoplastic resin containing 60 to 100%, especially 65 to 100% by weight of an ionomer resin neutralized with a divalent metal salt. If the content of the ionomer resin neutralized with a divalent metal salt is less than 60% by weight, there would result a loss of abrasion resistance and hence, a loss of surface durability against iron shots.

The metal ion of the divalent metal salt includes zinc and magnesium ions. The ionomer resins neutralized with a divalent metal salt are commercially available, for example, zinc salt neutralization type ionomer resins under the trade name of Himilan 1554 and 1706 by Mitsui-duPont Polychemicals K.K. and Surlyn 9320 by E. I. duPont; and magnesium salt neutralization type ionomer resins under the trade name of Himilan AM7311 by Mitsui-duPont Polychemicals K.K. These ionomer resins may be used alone or in admixture of two or more.

Another resin may be blended in the outer layer cover stock as long as the above-defined content of the specific ionomer resin is satisfied. Examples of the other resin which can be used herein include ionomer resins neutralized with a monovalent metal salt, for example, sodium salt neutralization type ionomer resins under the trade name of Himilan 1605 and Surlyn 8320; and lithium salt neutralization type ionomer resins under the trade name of Surlyn 7930, as previously exemplified.

The cover stocks for the inner and outer layers may further contain well-known additives such as pigments, dispersants, antioxidants, UV absorbers, UV stabilizers, and plasticizers, if necessary.

The hardnesses of the cover inner and outer layers should be adjusted such that the difference in Shore D harness between the cover inner layer and the cover outer layer is within 5, preferably within 3 and more preferably within 2 Shore D units. Preferably the cover inner layer and the cover outer layer independently have a Shore D hardness of 50 to 70, more preferably 51 to 68, especially 51 to 66. A Shore D hardness of less than 50 would lead to a loss of resilience whereas cover layers with a Shore D hardness of more than 70 would give a very hard feel beyond the practically acceptable level. The hardness used herein is as measured by the method of ASTM 2240.

The total gage of the cover thus formed is preferably 1 to 5 mm, especially 1.2 to 4.5 mm. Usually the cover inner layer and the cover outer layer independently have a gage or radial thickness of 0.5 to 3 mm, especially 0.6 to 2.5 mm. If either cover layer is thinner than 0.5 mm, the durability of the cover can be reduced against impact and thus cracked. If either cover layer is thicker than 3 mm, resilience would become low.

The solid golf ball having a cover of two-layer structure according to the invention may be prepared by molding and vulcanizing the above-described base rubber into a solid core, forming the cover inner layer on the core, and forming the cover outer layer thereon.

In the step of forming the solid core, a rubber composition is prepared by blending the above-described base rubber with a crosslinking agent, a co-crosslinking agent, an inert filler and optional additives while adjusting the blending ratio, then molding and vulcanizing the blend while adjusting the vulcanizing conditions. Examples of crosslinking agents include organic peroxides such as dicumyl peroxide and di-t-butyl peroxide, with dicumyl peroxide being especially preferred. The crosslinking agent is generally added in an amount of about 0.5 to 2 parts by weight per 100 parts by weight of the base rubber. Co-crosslinking agents that can be used include, without particular limitation, metal salts of unsaturated fatty acids, and preferably zinc and magnesium salts of unsaturated fatty acids having 3 to 8 carbons (e.g., acrylic acid and methacrylic acid), of which zinc acrylate is especially preferable. The amount of co-crosslinking agent added is preferably about 10 to 34 parts, especially 12 to 34 parts by weight per 100 parts by weight of the base rubber. Suitable inert fillers include zinc oxide, barium sulfate, silica, calcium carbonate and zinc carbonate, with zinc oxide and barium sulfate being most often used. The filler is usually blended in an amount of 15 to 35 parts by weight per 100 parts by weight of the base rubber, although this amount is governed in part by the specific gravities of the core and the cover, as well as weight standards for the ball, and is not subject to any particular limits. In the practice of the invention, a solid core having an appropriate hardness (as defined above by a deflection of a solid core under a load of 100 kg) can be obtained by adjusting the proportion of zinc oxide or barium sulfate blended.

The solid core-forming composition obtained by combining the above components is usually prepared in a conventional mixer such as a Banbury mixer or a roll mill, then compression or injection molded in a core mold. The molded part is then cured by heating at a sufficient temperature for the crosslinking agent and co-crosslinking agent to function (for example, a temperature of about 130 to 170° C. for a combination of dicumyl peroxide as the crosslinking agent and zinc acrylate as the co-crosslinking agent), obtaining a solid core.

The cover inner layer and cover outer layer are formed using the ionomer resin base cover stocks described above. The method of forming the cover inner layer on the solid core and the method of forming the cover outer layer on the cover inner layer are not critical. For example, the cover may be applied by preforming hemispherical half cups from the inner and outer layer cover stocks, lapping two pairs of half cups, encasing the solid core in the half cups, and molding under heat and pressure. Alternatively, the cover may be applied by successively injection the molding inner and outer layer cover stocks on the solid core.

Like conventional golf balls, the golf ball of the invention is formed with a multiplicity of dimples in the cover surface. The ball may have about 300 to 600 dimples, preferably about 310 to 550 dimples. The dimples may be distributed in any desired geometrical arrangement such as octahedral and icosahedral arrangements, and the pattern of dimples may be any of square, hexagon, pentagon, and triangle patterns.

The golf ball of the invention is prepared in accordance with the Rules of Golf, that is, to a diameter of not less than 42.67 mm and a weight of not greater than 45.93 grams.

While maintaining the superior flight performance and durability inherent to solid golf balls, the solid golf ball of the invention is improved in feel.

EXAMPLE

Examples of the present invention are given below by way of illustration and not by way of limitation. All parts are by weight.

Examples 1–4 & Comparative Examples 1–5

Three-piece solid golf balls were prepared by forming solid cores, cover inner layers and cover outer layers from the formulations shown in Tables 1 and 2 to the parameters shown in Tables 1 and 2.

More specifically, the solid cores were formed by kneading the respective components in a roll mill and press molding at 155° C. for 15 minutes. The cover inner layers were formed by injection molding, so as to enclose the surface of the solid cores. The cover outer layers were formed by injection molding, so as to enclose the outer surface of the inner layers.

The golf balls thus obtained were tested for distance, feel and durability. The results are shown in Tables 1 and 2.

Flight performance

Using a swing robot, the golf balls were measured for carry and total distance when hit with a driver (#W1) at a head speed of 45 m/s (HS45). The driver used was a PRO 230 Titan manufactured by Bridgestone Sports Co., Ltd. (loft angle 11°, shaft Harmotech Lite HM50J(HK carbon shaft), hardness S, balance $D_2$).

Feel

The balls were driven by three professional golfers with #W1 and a putter (#PT), who rated each ball according to the following criteria.

VS: very soft

S: soft

RH: rather hard

H: hard

Durability

Each golf ball was hit once with a sand wedge (#SW) at a head speed of 33 M/s. The surface of the ball was visually observed and rated according to the following criteria.

E: excellent

G: good

F: fair

P: damaged or notched

TABLE 1

| | E1 | E2 | E3 | E4 | E5 | E6 | E7 |
|---|---|---|---|---|---|---|---|
| Solid core Formulation (pbw) | | | | | | | |
| 1,4-cis-polybutadiene | 100 | 100 | 100 | 100 | 100 | 100 | 100 |
| Zinc acrylate | 24 | 30 | 23 | 28 | 20.5 | 26 | 26 |
| Dicumyl peroxide | 0.6 | 0.6 | 0.6 | 0.6 | 0.6 | 0.6 | 0.6 |
| Peptizer | 1 | 1 | 1 | 1 | 1 | 1 | |
| Antioxidant | 0.1 | 0.1 | 0.1 | 0.1 | 0.1 | 0.1 | 0.1 |
| Zinc oxide | 28.2 | 26.1 | 28.6 | 26.7 | 27.9 | 27.5 | 27.5 |
| Diameter (mm) | 36.5 | 37.3 | 36.5 | 36.5 | 35.1 | 36.5 | 36.5 |
| Hardness* (mm) | 4.3 | 3.3 | 4.6 | 3.65 | 5.5 | 4 | 4 |
| Cover inner layer Formulation (pbw) | | | | | | | |
| Himilan 1706 | — | — | 20 | — | — | — | — |
| Surlyn 9320 | 5 | — | — | 30 | — | — | — |
| Himilan 1605 | 95 | — | — | — | — | — | — |
| Surlyn 8320 | — | 40 | — | — | — | — | — |
| Surlyn 7930 | — | 60 | 80 | 70 | 100 | — | — |
| Surlyn AD8512 | — | — | — | — | — | 70 | 70 |
| Himilan AM7311 | — | — | — | — | — | — | — |
| D6100P Dynaron | — | — | — | — | — | 30 | 30 |
| Gage (mm) | 1.6 | 1.3 | 1.6 | 1.6 | 2.2 | 1.6 | 1.6 |
| Shore D Hardness | 60 | 53 | 62 | 54 | 63 | 56 | 56 |
| Cover outer layer Formulation (pbw) | | | | | | | |
| Himilan 1706 | 100 | 70 | 70 | 75 | — | 80 | — |
| Surlyn 9320 | — | 30 | — | — | — | — | — |
| Himilan 1554 | — | — | — | — | — | — | 100 |
| Himilan 1605 | — | — | 30 | — | — | — | — |
| Surlyn 8320 | — | — | — | 25 | — | 20 | — |
| Surlyn 7930 | — | — | — | — | 30 | — | — |
| Himilan AM7311 | — | — | — | — | 70 | — | — |
| Gage (mm) | 1.5 | 1.3 | 1.5 | 1.5 | 1.8 | 1.5 | 1.5 |
| Shore D Hardness | 60 | 53 | 62 | 54 | 63 | 56 | 56 |
| Golf ball | | | | | | | |
| Hardness* (mm) | 3 | 2.8 | 3.1 | 3 | 3 | 3.2 | 3.2 |
| #W1/HS45 | | | | | | | |
| Carry (m) | 211.2 | 211.2 | 211.5 | 211 | 211.8 | 211.5 | 211.5 |
| Total (m) | 226.3 | 225.8 | 227 | 226 | 227.3 | 226.8 | 226.8 |
| Feel | VS | S | VS | VS | VS | VS | VS |
| #PT | | | | | | | |
| Feel | S | VS | S | VS | VS | VS | VS |
| #SW/HS33 | | | | | | | |
| Scuff | E | G | E | G | E | G | G |

*Hardness is a deflection (mm) of a core or ball under a load of 100 kg

TABLE 2

| | CE1 | CE2 | CE3 | CE4 | CE5 | CE6 |
|---|---|---|---|---|---|---|
| Solid core Formulation (pbw) | | | | | | |
| 1,4-cis-polybutadiene | 100 | 100 | 100 | 100 | 100 | 100 |
| Zinc acrylate | 26 | 34 | 30 | 26 | 26 | 26 |
| Dicumyl peroxide | 0.6 | 0.6 | 0.6 | 0.6 | 0.6 | 0.6 |
| Peptizer | 1 | 1 | 1 | 1 | 1 | 1 |
| Antioxidant | 0.1 | 0.1 | 0.1 | 0.1 | 0.1 | 0.1 |
| Zinc oxide | 27.5 | 24.4 | 25.9 | 44.2 | 27.5 | 27.5 |
| Diameter (mm) | 36.5 | 36.5 | 36.5 | 32.7 | 36.5 | 36.5 |
| Hardness* (mm) | 4 | 2.8 | 3.3 | 4 | 4 | 4 |
| Cover inner layer Formulation (pbw) | | | | | | |
| Himilan 1706 | 50 | 50 | 50 | 80 | 70 | — |

TABLE 2-continued

| | CE1 | CE2 | CE3 | CE4 | CE5 | CE6 |
|---|---|---|---|---|---|---|
| Surlyn 9320 | — | — | 50 | — | 30 | — |
| Himilan 1605 | — | — | — | — | — | 80 |
| Surlyn 8320 | — | — | — | 20 | — | 20 |
| Surlyn 7930 | — | — | — | — | — | — |
| Surlyn AD8512 | — | — | — | — | — | — |
| Himilan AM7311 | 50 | 50 | — | — | — | — |
| D6100P Dynaron | — | — | — | — | — | — |
| Gage (mm) | 1.6 | 1.6 | 1.6 | 3.2 | 1.6 | 1.6 |
| Shore D Hardness | 61 | 61 | 47 | 56 | 53 | 56 |
| Cover outer layer Formulation (pbw) | | | | | | |
| Himilan 1706 | — | 30 | — | — | 70 | — |
| Surlyn 9320 | — | — | — | 40 | 30 | — |
| Himilan 1554 | — | — | — | — | — | — |
| Himilan 1605 | 100 | 70 | — | 60 | — | 80 |
| Surlyn 8320 | — | — | 60 | — | — | 20 |
| Surlyn 7930 | — | — | 40 | — | — | — |
| Himilan AM7311 | — | — | — | — | — | — |
| Gage (mm) | 1.5 | 1.5 | 1.5 | 1.8 | 1.5 | 1.5 |
| Shore D Hardness | 61 | 61 | 47 | 51 | 53 | 56 |
| Golf ball | | | | | | |
| Hardness* (mm) | 2.8 | 2.1 | 3.2 | 2.8 | 3.4 | 3.2 |
| #W1/HS45 | | | | | | |
| Carry (m) | 211 | 211.5 | 207.5 | 207 | 206.1 | 210.2 |
| Total (m) | 226.3 | 226.6 | 221.3 | 221.5 | 219.3 | 224.5 |
| Feel | VS | H | S | S | VS | S |
| #PT | | | | | | |
| Feel | RH | H | VS | VS | VS | S |
| #SW/HS33 | | | | | | |
| Scuff | P | F | P | P | E | P |

*Hardness is a deflection (mm) of a core or ball under a load of 100 kg

Note that Himilan is the trademark for ionomer resins by Mitsui-duPont Polychemicals K.K.;

Surlyn is the trademark for ionomer resins by E. I. dupont; and

Dynaron is the trademark for thermoplastic elastomers having crystalline ethylene blocks by Nippon Synthetic Rubber K.K.

It is evident from Tables 1 and 2 that three-piece solid golf balls of the invention are improved in feel while maintaining excellent flight performance. The balls travel longer distances and are also improved in durability.

Japanese Patent Application No. 219284/1997 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A solid golf ball comprising a solid core and a cover consisting of an inner layer and an outer layer, characterized in that the cover inner layer is formed of a thermoplastic resin containing 60 to 100% by weight of an ionomer resin neutralized with a monovalent metal salt and has a Shore D hardness of 50 to 68, the cover outer layer is formed of a thermoplastic resin containing 60 to 100% by weight of an ionomer resin neutralized with a divalent metal salt, and the difference in hardness between the cover inner layer and the cover outer layer is within 5 on Shore D hardness scale.

2. The solid golf ball of claim 1 wherein the cover outer layer has a Shore D hardness in the range of 50 to 70.

3. The solid golf ball of claim 1 wherein the solid core is formed of a rubber composition based on polybutadiene and undergoes a deflection of 3 to 7 mm under an applied load of 100 kg.

4. The solid golf ball of claim 1 wherein the cover inner layer and the cover outer layer each have a gage of 0.5 to 3 mm.

5. The solid golf ball of claim 1 wherein the cover inner layer has a Shore D hardness of 51 to 66.

6. The solid golf ball of claim 1 wherein the cover outer layer is formed of a thermoplastic resin containing 65 to 100% by weight of an ionomer resin neutralized with a divalent metal salt.

7. The solid golf ball of claim 1 wherein the difference in hardness between the cover inner layer and the cover outer layer is within 3 degrees on Shore D hardness scale.

8. The solid golf ball of claim 1 wherein the difference in hardness between the cover inner layer and the cover outer layer is within 2 degrees on Shore D hardness scale.

9. A multi-piece golf ball comprising:

a core composed substantially of a rubber composition, and having a diameter of about 35 to 40 mm;

an inner cover layer formed of a thermoplastic resin containing 60 to 100% by weight of an ionomer resin neutralized with a monovalent metal salt, having a gage of about 1.6 to 2.2 mm, and a Shore D hardness of about 51 to 66; and an outer cover layer formed of a thermoplastic resin containing 60 to 100% by weight of an ionomer resin neutralized with a divalent metal salt, having a gage of about 1.3 to 1.8 mm, and a Shore D hardness of about 51 to 66, and wherein the difference in the Shore D hardness between the inner and outer cover layers is less than 5 degrees.

10. The multi-piece golf ball as defined in claim 9, wherein the core is based on polybutadiene and undergoes a deflection of 3 to 7 mm under an applied load of 100 kg.

11. The multi-piece golf ball as defined in claim 9, wherein the difference in the Shore D hardness of the inner and outer cover layers is about 0 to 3.

12. The multi-piece golf ball as defined in claim 11, wherein the golf ball has a deflection of about 3.0 mm under an applied load of 100 kg.

13. The multi-piece golf ball as defined in claim 12, wherein the outer cover layer has 310 to 550 dimples formed on its surface.

14. The multi-piece golf ball as defined in claim 11, wherein the total gage of the inner and outer cover layers is about 1.2 to 4.5 mm.

* * * * *